United States Patent [19]

Kuroki et al.

[11] 4,077,771

[45] Mar. 7, 1978

[54] PROCESS FOR TREATING FIBROUS MATERIAL

[75] Inventors: Tomio Kuroki; Teramae Kazuhiro, both of Otsu, Japan

[73] Assignee: Toyo Boseki Kabushiki Kaisha, Osaka, Japan

[21] Appl. No.: 703,297

[22] Filed: Jul. 7, 1976

[30] Foreign Application Priority Data

Jul. 16, 1975 Japan ..... 50-87652

[51] Int. Cl.[2] ..... D06M 13/40

[52] U.S. Cl. ..... 8/196; 8/DIG. 2; 8/190

[58] Field of Search ..... 8/DIG. 2, 120, 183, 8/185, 190, 193, 196, 94.14

[56] References Cited

U.S. PATENT DOCUMENTS

| | | | |
|---|---|---|---|
| 2,459,222 | 1/1949 | Guthrie | 8/196 |
| 2,550,638 | 4/1951 | Dawson | 8/94.33 |
| 2,550,639 | 4/1951 | Dawson | 8/94.33 |
| 2,688,607 | 9/1954 | Suen | 8/94.33 |
| 3,309,363 | 3/1967 | Buell | 8/183 |
| 3,778,226 | 12/1973 | Kissa | 8/185 |

OTHER PUBLICATIONS

W. E. Franklin, "Textile Research Journal", vol. 42, No. 9, Sep. 1972, pp. 553–557.

*Primary Examiner*—Paul R. Michl

*Attorney, Agent, or Firm*—Wenderoth, Lind & Ponack

[57] ABSTRACT

A process for inhibiting fiber yellowing occuring at the time of the alkaline treatment, which comprises treating fibrous material with an alkaline substance, a functional compound capable of reacting under alkaline conditions, and aminoacid or the derivative thereof, and thereafter subjecting said treated fibrous material to the heat treatment at a temperature of 100° C or higher.

12 Claims, No Drawings

PROCESS FOR TREATING FIBROUS MATERIAL

THE BACKGROUND OF THE INVENTION

The present invention relates to a process for treating fibrous material and more particularly to a process for inhibiting discoloration occurring when said fibrous material is heat-cured in the presence of an alkaline catalyst.

Heretofore, there have been known that treatment methods comprising heat-curing cellulosic fibrous material by using such a cross-linking agent as bis (β-hydroxyethyl)sulfone, and an alkaline catalyst. When such a heat-curing treatment is carried out in the presence of the alkaline catalyst, however, the treatment is accompanied by a tendency of the fibrous material to discolor into colar shades ranging from light yellow to yellowish brown shades, although the color shade formed during the heat-curing treatment somewhat varies with the kind of fibre being applied, the kind of cross-linking agent being used, the kind and concentration of an alkaline substance, the heating temperature and the duration of the heat-curing step. And this discoloration may be somewhat eliminated by carrying out an after-bleaching operation on the fibrous material with hydrogen peroxide or the like. But the more intense the discoloration, the more difficult becomes the elimination. In addition, it is also difficult to carry out an after-bleaching operation on dyed fibrous material. These have been disturbing the industrialization of the heat-curing treatment method using the alkaline catalyst.

In order to inhibit the fibre yellowing occuring when the fibre material is heat-cured in the presence of the alkaline catalyst, there has hitherto been known a method using a boron-containing compound as disclosed in the U.S. Pat. No. 3,498,736. However, alkali metal borohydride which is a typical example of the boron-containing compounds, has drawbacks in that the chemical is high in cost, that the obtained whiteness of fibrous material is liable to vary with slight changes in the addition amount and in the conditions for heat-treatment, and that the chemical cannot be applied to dyed cloth because of its strong reduction bleaching properties. Also, the other typical example, borates, for example, borax or the like has a difficulty in operation control in factory production due to the fact that the preparation of the treating liquid becomes complicated because of its low solubility (only 1 gram of borax per 161 ml of water is dissolved), and that the whiteness of the fibrous material is liable to vary with the changes in the conditions for the heat treatment.

THE SUMMARY OF THE INVENTION

An object of the present invention is to provide an alkaline heat-curing process for fibrous materials, which is free from the above mentioned drawbacks.

Another object of the present invention is to provide an alkaline heat-curing process for fibrous materials with a reduced tendency to discoloration.

Still another object of the present invention is to provide an alkaline heat-curing process for dyed fibrous materials with a reduced tendency to discoloration.

The other object of the present invention is to provide an alkaline heat-curing process for causing less change in obtained whiteness and color shades in spite of the changes in the conditions for the heat-curing treatment and the composition of the treating liquid, that is, an alkaline heat-curing process for imparting fibrous material whiteness and color shades which are excellent in reproducibility. Other objects and advantages than the above will be made clear by the descriptions given below.

The present inventors have made an intensive study on a process for inhibiting discoloration of fibrous material, which is free from the above mentioned drawbacks and effective and reproducible on both bleached cloth and dyed cloth, that is, easy of operation control; and have accomplished the process of the present invention. That is, the present invention is characterized in that fibrous material is treated with a functional compound capable of reacting under alkaline conditions and an alkaline catalyst and aminoacid or the derivative thereof, and thereafter the treated fibrous material is subjected to heat treatment.

If the process of the present invention is used, the present process offers many advantages that, in spite of slight changes in the amount of aminoacid or the derivatives thereof being used and in the conditions for the heat treatment, an effect which is good in reproducibility can be produced on the inhibition of yellowing, that an excellent yellowing inhibition effect is produced not only on bleached cloth but also on dyed cloth, and that the treating liquid can be prepared with great ease. In addition to these advantages, the present process has a further advantage in that, in case cellulose fibre is subjected to crease-proofing processing or wash and wear finishing processing by means of a cross-linking formation, a reduction in strength can be inhibited.

DETAILED EXPLANATION OF THE INVENTION

Suitable for use in the process of the present invention as the functional compounds capable of reacting under alkaline conditions are derivatives of divinyl sulfone or divinyl sulfoxide, above all, bis(β-hydroxyethyl)sulfone represented by the general formula:

$$R_1OCH_2CH_2SO_2(R_3SO_2)mCH_2CH_2OR_2$$

$$R_1OCH_2CH_2SO(R_3SO)mCH_2CH_2OR_2$$

(wherein $R_1$ and $R_2$ : Hydrogen or lower alkyl group having 1 to 4 carbon atoms $m$ : 0 or 1

$R_3$ : Alkylene group having 1 to 6 carbon atoms, $-(R_4O)n-R_4-$, or phenylene group.

$R_4$ : Alkylene group having 2 to 4 carbon atoms $n$ : An integer of 0 or 1 to 50.

There can also be exemplified activated vinyl compounds such as divinyl sulfone and tris(acryloyl)hexahydrotriazine; epoxy compounds such as glyceroldiglycidylether and ethyleneglycoldiglycidylether; N-methylol compounds such as trimethylol malamine, methylated trimethylol melamine, dimethylol urea and methylol acrylamide; or crease-proofing agents and wash and wear agents. In addition to these, reactive dyestuffs containing s-triazinyl group or pyrimidyl group having halogen atoms, reactive dyestuffs containing β-hydroxyethyl sulfonyl group and polysiloxane having methyl hydrogen siloxane unit, and the like may be used as the functional compounds.

The amount of the functional compound to be used may vary according to the fibre material being applied and the treatment object, but it is usually 0.2 to 30%, preferably 2 to 20% based on the weight of the fibre material being used.

Further, suitable for use in the present invention as the alkaline catalyst are alkali metal carbonate such as sodium carbonate and potassium carbonate; and alkali metal bicarbonate such as sodium bicarbonate and potassium bicarbonate. In addition to these, there can also be mentioned alkali metal hydroxide, alkali metal phosphate, alkali metal silicate and alkali metal acetate or the like. The amount of the alkaline catalyst to be used may vary according to the kind and amount of the functional compound, the kind of the catalyst, and the conditions for the heat treatment or the like, but, as far as the amount usually yields a pH value of 7.5 or more, preferably 9.5 to 11.0, it is enough. The concentration of the catalyst in the treating liquid is usually 0.01 to 10% by weight, preferably 0.1 to 5% by weight.

the aminoacid or the derivatives thereof for use in the process of the present invention include glycine, alanine, leucine, serine, aspartic acid, glutamic acid, lysine, $\beta$-alanine, $\gamma$-amino butyric acid, amino benzoic acid, anthranilic acid, and $\gamma$-methylglutamic acid and the like. Besides, anhydrides of $\alpha$-aminoacid or the like can be mentioned, but glycine is more preferably used.

The amount of aminoacid to be used may vary according to the kinds and amounts of the functional compound and the catalyst, and the conditions for the heat treatment, but it is usually 0.02 to 5.0% by weight, preferably 0.1 to 2.0% by weight in terms of the solution concentration. It is usually 0.5 to 20%, preferably 2 to 10% based on the weight of the functional compound being used.

Further, the fibrous materials to be used in the process of the present invention include natural or regenerated cellulose fibres such as cotton, linen, viscose rayon, cuprammonium rayon, polynosic rayon, high wet modulus rayon; protein fibres such as wool, silk and furs; semi-synthetic fibres such as cellulose acetate and protein-acrylonitrile graft copolymer fibre; synthetic fibres such as polyester, polyamide, polyvinylalcohol and polyacrylonitrile, and fibre masses, yarns, knitted or woven fabrics, felts, non-woven fabrics, and the like produced from these fibres. If the present process is applied to cellulose fabrics, especially, blended fabrics composed of a blended fibre of cellulose fibre and polyester fibre, the present process produces a conspicuous effect on the inhibition of yellowing. Further, when the heat treatment is carried out on a fibre which does not contain any active hydrogen capable of reacting with the functional compound, it is difficult to make the functional compound fix to the fibre. In such a case, the treatment can be carried out by using the functional compound in combination with a polymer having such active hydrogen as hydroxyl group and amide group, for example, such as polyvinyl alcohol, polyacrylamide, a copolymer of acrylamide or hydroxyethylacrylate with other copolymerizable ethylenically unsaturated monomer, hydroxyethyl cellulose, methyl cellulose, starch and carbamoylethyl starch, whereby for example, an anti-static effect and a durable stiff finish effect or the like can also be obtained.

The treatment process of the present invention will be further explained below in more detail.

An aqueous liquid obtained by mixing said functional agent capable of reacting under alkaline conditions, said alkaline catalyst and said aminoacid and if necessary adding a softening agent, a sizing agent, other hand modifiers and a dyestuff or the like, is applied to fibrous material by padding, spraying, coating, transferring or any other desired manner, and thereafter the treated fibrous material is usually dried and then heat-treated at 100° to 220° C, more preferably 120° to 190° C. Following the heat treatment, the treated fibrous material may usually be scoured with an acid, then washed with water and finally dried. For white goods an after-bleaching treatment using hydrogen peroxide is further carried out on same if necessary, and thereafter, said materials are rinsed with water and dried.

According to the process of the present invention, the crease recovery properties, stiff finish, anti-static properties, soil-releasing properties or the like, which are durable, can be imparted to fibrous material without causing any discoloration, depending upon the kind of the functional compound used, and the kinds of a softening agent, a sizing agent and a feeling adjuster used in combination with said functional compound as occasion demands.

The present invention will be explained below by way of Examples. All parts and % referred to in the Examples are parts by weight and % by weight.

EXAMPLE 1:

A broad cloth composed of a blended fibre of polyester/cotton (65/35) fibres, scoured, bleached and fluorescent-whitened in known manner, was immersed in a treating liquid prepared on a prescription given below. The broad cloth was then squeezed to a wet pick-up of 70%, and then dried at 90° C for 3.5 minutes and thereafter heat-treated at 150° C for 3 minutes.

| Prescription | |
|---|---|
| bis($\beta$-hydroxyethyl)sulfone | 10 parts |
| Sodium carbonate anhydride | 2 parts |
| Discoloration inhibitor | X parts |
| Ex-200 (a polyester-polyether block copolymer 10 % dispersion softening agent, produced by Toyo Spinning Co., Ltd.) | 2 parts |
| Water | balance |
| Total | 100 parts |

The resulting treated broad cloth was split into half. One piece of the split cloth was scoured with an aqueous 0.5% acetic acid solution, then rinsed with water and dried. Thereafter, the whiteness (−b value) of the resulting fibrous material was measured by use of a digital color difference meter Model ND-101D produced by Nippon Denshoku Kogyo Co., Ltd. The other piece of the cloth was bleached at 80° C for 10 minutes with an aqueous solution consisting of an aqueous 1.0% hydrogen peroxide, 0.2% sodium silicate, and 0.1% sodium hydroxide. The bleached cloth was thereafter rinsed with water and dried. Then the −b value was measured. The result is as shown in Table 1.

Table I

| Sample | Discoloration Inhibitor (part) | Whiteness (−b value) After scouring | Whiteness (−b value) After bleaching | Judgment by naked eye After scouring | Judgment by naked eye After bleaching | pH of the treating liquid |
|---|---|---|---|---|---|---|
| Untreated | — | (13.6) | — | — | — | — |
| A (Blank) | nil | 7.8 | 9.8 | X | Δ | 10.8 |

Table I-continued

| Sample | Discoloration Inhibitor (part) | Whiteness (−b value) After scouring | Whiteness (−b value) After bleaching | Judgment by naked eye After scouring | Judgment by naked eye After bleaching | pH of the treating liquid |
|---|---|---|---|---|---|---|
| B (The present invention) | glycine 0.5 | 10.1 | 11.7 | Δ~○ | ○~◎ | 10.3 |
| C (The present invention) | glycine 1.0 | 11.0 | 12.2 | ○ | ○ ◎ | 10.0 |
| D (Comparative Example) | Nitrilo-triacetic acid 0.1 | 8.4 | — | X | — | 10.5 |
| E (Comparative Example) | Nitrilo-triacetic acid 0.5 | 8.1 | — | X | — | 9.8 |
| F (Comparative Example) | Ammonium sulfite 0.5 | 8.0 | — | X | — | 10.2 |
| G (Prior art process) | Sodium borohydride 0.05 | 12.0 | 12.5 | ○ ◎ | ◎ | 10.9 |
| H (Prior art process) | Borax 0.4 | 11.0 | 11.7 | ○ | ○ ◎ | 10.4 |

* X : Bad
Δ : Slightly bad
○ : Good
◎ Very good

As is apparent from the Table 1, yellowing of fibre material occuring at the time of the heat treatment can conspicuously be inhibited by the process of the present invention involving the addition of glycine and at the same time good whiteness can be obtained by a mild bleaching operation carried out after the heat treatment. The addition of glycine somewhat lowers the pH of the treating liquid. However, this has no immediate connection with the inhibition of discoloration. This is apparent from the fact that the Comparative Examples using nitrilotriacetic acid or ammonium sulfite did not produce any effect on the inhibition of discoloration. Further, there is obtained an advantage that the lowering of abrasion resistance which occurs in the course of cross-linking of cellulose components can largely be inhibited by the addition of glycine. On the contrary, the prior art processes using boron-containing compounds have imparted good whiteness to fibrous material, but sodium borohydride has a drawback in that even a very small change in the addition amount is liable to cause a change in whiteness, thus making the operation control difficult. Also borax has drawbacks in that it has so low a solubility in water that the preparation of the treating liquid becomes complicated and that even a very small change in the conditions for the heat treatment is liable to cause a change in whiteness.

EXAMPLE 2

A broad cloth composed of a blended polyester/cotton (65/35) fibres consisting of polyester fibre dyed with Resorin Blue - FBL (C.I. Disperse Blue - 56, produced by Bayer Company) and cotton fibre dyed with Indanthrene Blue - CLF (C.I. Vat Blue - 66, produced by BASF Company) in known manner was immersed in the treating liquid of the Example 1. The broad cloth was then squeezed to a wet pick-up of 70%, and dried at 90° C for 3.5 minutes and thereafter heat-treated at 150° C for 3 minutes. After the completion of the heat treatment, the treated broad cloth was scoured with an aqueous acetic acid solution, rinsed with water and dried. The colorimetry measurement of the resulting treated broad cloth was conducted by the L, *a* and *b* values by use of the color difference meter. The result is as shown in Table 2.

Table 2

| Sample | Discoloration inhibitor (part) | Colorimetry Result L | a | b | Judgment by naked eye |
|---|---|---|---|---|---|
| Untreated | — | 59.1 | 0 | −26.3 | — |
| A (Blank) | nil | 59.0 | −0.9 | −20.2 | X-Δ |
| B (The present invention) | glycine 0.5 | 58.9 | −0.2 | −25.4 | ○ |
| C (The present invention) | glycine 1.0 | 59.1 | 0.1 | −25.9 | ○ |
| G (Prior art process) | sodium boro-hydride 0.05 | — | — | — | X |
| H (Prior art process) | borax 0.4 | 59.0 | 0.2 | −25.6 | ○ |

As is apparent from the Table 2, the discoloration of the dyed cloth could be inhibited by the process of the present invention involving the addition of glycine. The addition of 1.0 part (1.0%) of glycine could inhibit the discoloration almost completely.

On the contrary, sodium borohydride cannot be applied to dyed cloth because of its reduction bleaching action. Borax has a good effect on the inhibition of discoloration, but it has so poor a solubility in water that the preparation of the treating liquid becomes very complicated.

EXAMPLE 3

A broad cloth consisting of 100% cotton scoured, bleached and fluorescent-whitened in known manner, was immersed in a treating liquid prepared on a prescription given below. The broad cloth was squeezed to a wet pick-up of 75% and thereafter dried at 90° C for 3.5 minutes. The broad cloth was then heat-treated at 150° C for 3 minutes and thereafter scoured with an aqueous acetic acid solution, rinsed with water and dried.

| Prescription | |
|---|---|
| bis(β-hydroxyethyl)sulfone | 15 parts |
| Sodium carbonate | 2 parts |
| Meikatex PET (Montan wax type softening agent, produced by Meisei Kagaku Company) | 2 parts |
| X-51-150 (a dimethyl siloxane-methyl hydrogen siloxane copolymer about 20 % dispersion softening agent produced by Shinethu Kagaku Company) | 2 parts |
| Discoloration inhibitor | X parts |
| Water | balance |
| Total | 100 parts |

The resulting treated broad cloth was bleached at 90° C for 10 minutes with an aqueous solution consisting of aqueous 1.0% hydrogen perioxide, 0.2% sodium silicate and 0.1% sodium hydroxide. Thereafter, the cloth was washed with water, and dried. The whiteness, crease recovery properties (C method of JIS L-1041), flex abrasion resistance (Universal method of JIS L-1005), tensile strength (JIS L-1068 Strip method, 2.5 cm in width), and wash and wear properties (W-W properties, drip dry method, AATCC 88A-1964T IIA) of the treated broad cloth were evaluated. The result is as shown in Table 3.

Table 3

| Sample Material | Discoloration inhibitor (part) | Whiteness (−b) | Crease recovery (Warp + Filling) (degree) Dry | Wet | W-W (rating) | Tensile strength (kg) | Flex abrasion resistance (cycles) |
|---|---|---|---|---|---|---|---|
| Untreated | — | 8.5 | 170 | 180 | 1 | 25.8 | 900 |
| I (Blank) | nil | 5.1 | 286 | 285 | 4 | 10.5 | 180 |
| J (The present invention) | glycine 0.5 | 7.5 | 280 | 282 | 4 | 12.6 | 285 |
| K (The present invention) | glycine 1.0 | 7.8 | 271 | 276 | 3–4 | 14.8 | 383 |
| L (Prior art process) | borax 0.4 | 7.7 | 280 | 280 | 4 | 10.5 | 167 |
| M (Prior art process) | borax 0.8 | 7.8 | 275 | 274 | 3–4 | 10.6 | 208 |

Table 3 shows that when glycine was added as the discoloration inhibitor, reductions in whiteness and in strength could be improved without substantially lowering the crease recovery properties and wash and wear properties. On the contrary, the Comparative Example using borax shows that a reduction in whiteness could be improved but the strength was almost equal to that of the Blank.

EXAMPLE 4

In the same manner as used in the Example 1, a blended broad cloth consisting of polyester/cotton fibres used in Example 1, was heat-treated with a treating liquid prepared on a prescription given below. Thereafter, the treated cloth was scoured with an aqueous acetic acid solution, rinsed with water and dried. The whiteness (−b value) of the cloth was measured by use of the color difference meter. The colorimetry result is as shown in Table 4.

| Prescription | |
|---|---|
| Bis(β-hydroxyethyl)sulfone | 12 parts |
| Reactive polyacrylic emulsion (an acrylamide/ethylacrylate/butylacrylate = 2/50/48 mol % copolymer 30 % dispersion) | 2 parts |
| Sodium bicarbonate | 2.5 parts |
| Discoloration inhibitor | X parts |
| Water | (balance) |
| Total | 100 parts |

Table 4

| Sample | Discoloration inhibitor (part) Glycine | Borax | Whiteness (−b) |
|---|---|---|---|
| Untreated | — | — | 13.6 |
| N (Blank) | — | — | 9.9 |
| O (The present invention) | 0.5 | — | 12.0 |
| P (The present invention) | 1.0 | — | 12.8 |
| Q (prior art process | — | 0.2 | 10.7 |
| R (Prior art process) | — | 0.4 | 12.3 |
| S (The present invention) | 0.2 | 0.2 | 12.8 |

Table 4-continued

| Sample | Discoloration inhibitor (part) Glycine | Borax | Whiteness (−b) |
|---|---|---|---|
| T (The present invention) | 0.5 | 0.2 | 13.5 |

When glycine and borax were used in combination as the discoloration inhibitor, a conspicuous effect was produced on the inhibition of discoloration as a result of the synergistic effect. Further, since the amount of borax required for use was very small, there was no complicatedness in preparing the treating liquid.

EXAMPLE 5

A broad cloth consisting of 100% cotton scoured, bleached, mercerized and fluorescent-whitened in known manner was immersed in a treating liquid prepared on a prescription given below, and treated at 80° C for 60 minutes at a bath ratio of 1 : 10 while circulating the treating liquid. After the treatment, the borad cloth was rinsed with water and dried.

| Treating liquid | |
|---|---|
| Tris(acryloyl)hexahydrotriazine | 1 part |
| Sodium sulfate anhydride | 10 parts |
| Sodium carbonate anhydride | 1 part |
| Water | 8 parts |

Subsequently the resulting treated cloth was padded with a treating liquid prepared on a prescription given below and squeezed to a wet pick-up of 70%. After the squeezing, the cloth was dried and thereafter heat-treated at 150° C for 3 minutes. It was then rinsed with water and dried.

| Treating liquid | |
|---|---|
| Sodium bicarbonate | 1 part |
| Glycine | X parts |
| Polyethylene 20 % dispersion (softening agent) | 2 parts |
| Water | balance |
| Total | 100 parts |

The whiteness and crease recovery properties of the resulting treated cloth were evaluated. The result is as shown in Table 5.

Table 5

| Sample Material | Whiteness (−b) | Crease recovery Dry | Wet | Flex abrasion resistance (cycles) |
|---|---|---|---|---|
| U (subjected to immersion treatment only) | 8.4 | 225 | 298 | 350 |
| V (glycine 0.5 part) | 7.8 | 266 | 295 | 430 |
| W (without glycine) | 4.8 | 267 | 293 | 340 |

Table 5-continued

| Sample Material | Whiteness (−b) | Crease recovery Dry | Crease recovery Wet | Flex abrasion resistance (cycles) |
|---|---|---|---|---|
| Untreated | 8.5 | 170 | 180 | 900 |

EXAMPLE 6

A broad cloth of 100% cotton scoured, bleached, mercerized and fluorescent-whitened in known manner was padded with a treating liquid prepared on a prescription given below, and squeezed to a wet pick-up of 80%. After the squeezing, the cloth was dried and subsequently heat-treated at 150° C for 3 minutes, and then rinsed with water and dried. The whiteness and crease recovery properties of the resulting treated cloth were evaluated and the result is as shown in Table 6.

| Treating liquid | |
|---|---|
| Trimethyl melamine | 5 parts |
| N-methylol acrylamide | 5 parts |
| Polyethylene 20 % dispersion | 2 parts |
| Sodium bicarbonate | 2 parts |
| Glycine | X parts |
| Water | balance |
| Total | 100 parts |

Table 6

| Sample | Whiteness (−b) | Crease recovery Dry | Crease recovery Wet |
|---|---|---|---|
| Glycine 1 part | 7.9 | 268 | 272 |
| Without glycine | 4.9 | 267 | 270 |
| Untreated | 8.5 | 170 | 180 |

What is claimed is:

1. In a process for treating fibrous material which comprises applying to said fibrous material an alkaline substance and a functional compound capable of reacting under alkaline conditions selected from the group consisting of a compound represented by the general formulas (I) and (II) given below:

$$R_1OCH_2CH_2SO_2(R_3SO_2)mCH_2CH_2OR_2 \quad (I)$$

$$R_1OCH_2CH_2SO(R_3SO)mCH_2CH_2OR_2 \quad (II)$$

wherein $R_1$ and $R_2$: hydrogen or lower alkyl group having 1 to 4 carbon atoms $R_3$: alkylene group having 1 to 6 carbon atoms, —($R_4$O)n—$R_4$—, or phenylene group, $R_4$: alkylene group having 2 to 4 carbon atoms $m$ : 0 or 1

$n$ : an integer of 0 or 1 to 50, and the compound tris(acryloyl) hexahydrotriazine, and thereafter heat-treating said fibrous material at a temperature of 100° C or higher, the improvement which comprises carrying out said process in the presence of an effective amount of an amino acid to inhibit the yellowing of the fibrous material, said amino acid selected from the group consisting of glycine, alanine, leucine, serine, aspartic acid, glutamic acid, lysine, β-alanine, γ-aminobutyric acid, amino benzoic acid, anthranilic acid and γ-methyl glutamic acid.

2. A process as defined in claim 1, wherein said aminoacid is glycine.

3. A process as defined in claim 1, wherein said heat treatment is carried out at a temperature of 120° to 190° C.

4. A process as defined in claim 1, wherein said fibrous material is a knitted or a woven fabric or a nonwoven fabric composed of cellulose fibre or a blended fibre of cellulose fibre/polyester fibre.

5. A process as defined in claim 1, wherein said alkaline substance is the carbonate, bicarbonate, or phosphate of an alkali metal.

6. A process as defined in claim 1, wherein said alkaline substance is sodium carbonate, potassium carbonate, sodium bicarbonate or potassium bicarbonate.

7. A process as defined in claim 1, wherein said functional compound capable of reacting under alkaline conditions is a compound represented by the general formulas (I) and (II) given below:

$$R_1OCH_2CH_2SO_2(R_3SO_2)mCH_2CH_2OR_2 \quad (I)$$

$$R_1OCH_2CH_2SO(R_3SO)mCH_2CH_2OR_2 \quad (II)$$

wherein $R_1$ and $R_2$: hydrogen or lower alkyl group having 1 to 4 carbon atoms $R_3$: alkylene group having 1 to 6 carbon atoms, —($R_4$O)n—$R_4$—, or phenylene group $R_4$: alkylene group having 2 to 4 carbon atoms $m$ : 0 or 1

$n$ : an integer of 0 or 1 to 50

8. A process as defined in claim 1, wherein said functional compound capable of reacting under alkaline conditions is bis(β-hydroxyethyl)sulfone.

9. A process as defined in claim 1, wherein said functional compound capable of reacting under alkaline conditions is tris(acryloyl) hexahydrotriazine.

10. A process as defined in claim 1, wherein said aminoacid is used in an amount of 0.5 to 20% by weight based on the weight of the functional compound capable of reacting under alkaline conditions.

11. A process as defined in claim 10, wherein the amino acid is used in an amount of 2 to 10% based on the weight of said functional compound.

12. Fibrous materials treated by the process of claim 1.

* * * * *